US007220137B1

(12) United States Patent
Liu

(10) Patent No.: US 7,220,137 B1
(45) Date of Patent: May 22, 2007

(54) COVER FOR MULTIPLEX RECEPTACLE SET

(75) Inventor: Wei Ho Liu, Tucheng (TW)

(73) Assignee: Ta Hsing Electric Wire & Cable Co., Ltd., Taipei (TW)

( * ) Notice: Subject to any disclaimer, the term of this patent is extended or adjusted under 35 U.S.C. 154(b) by 156 days.

(21) Appl. No.: 11/184,882

(22) Filed: Jul. 20, 2005

(51) Int. Cl.
*H01R 13/44* (2006.01)

(52) U.S. Cl. ..... 439/136; 439/134; 220/836; 220/840; 220/375

(58) Field of Classification Search ..... 439/135, 439/136, 142, 371, 134; 220/836, 840, 375; 24/614, 615
See application file for complete search history.

(56) References Cited

U.S. PATENT DOCUMENTS 4,408,813 A * 10/1983 Koehler ..... 439/148
4,707,043 A * 11/1987 Reed ..... 439/142
5,076,437 A * 12/1991 Schindler ..... 206/551
5,238,416 A * 8/1993 Dickie ..... 439/148
5,417,339 A * 5/1995 Liu ..... 220/315
2003/0207601 A1* 11/2003 Adachi ..... 439/135
2005/0242105 A1* 11/2005 Homann ..... 220/840

* cited by examiner

*Primary Examiner*—Tho D. Ta
(74) *Attorney, Agent, or Firm*—Troxell Law Office, PLLC

(57) ABSTRACT

A cover for a multiplex and multi-directional receptacle set in which each of a plurality of receptacles is provided on a lateral side thereof with an insertion socket formed integrally therewith and having a through hole; a plurality of covers same as the said cover can cover the receptacles and each has a bent strip extended laterally thereof; the bent strip has a conical engaging block on its tailing end. The engaging blocks are used to be directly engaged in the through holes of the insertion sockets to form connection; so that the covers are kept at the sockets to be opened or closed relative to the sockets. Thereby, the covers are easily and firmly assembled at the sockets to be convenient for operation of a user to open or close, and an effect of saving material can be obtained.

5 Claims, 4 Drawing Sheets

COVER FOR MULTIPLEX RECEPTACLE SET

BACKGROUND OF THE INVENTION

1. Field of the Invention

The present invention is related to a cover for a multiplex and multi-directional receptacle set, and especially to a brand-new structure of a cover that can be connected by inserting an engaging block on a tailing end of a bent strip into a through hole provided on an insertion socket integrally formed on each of the receptacles on a main body of the multiplex and multi-directional receptacle set.

2. Description of the Prior Art

Generally, a conventional one-for-plural receptacle set was designed to be of the style with one or two sides, i.e., a plug on the tailing end of an electric line was connected with an elongate rectangular box on one or two sides of which plural receptacles were arranged linearly. This can get a one-for-plural effect, however, the receptacles are closely arranged along straight lines, plugs are very hard to be plugged in or extracted.

Afterwards, a multiplex and multi-directional receptacle set with plural receptacles facing to multiple directions was developed to have the plural receptacles provided at the tailing end of an electric line of a plug, thus the above problem is solved. The receptacles are integrally formed on a main body after electrodes are well allocated; for example, a triplex receptacle set can be formed in this mode.

Each receptacle on such a multi-directional receptacle set extends individually to a different direction; in order to prevent entering of dust or rain drops through the unused receptacles, each receptacle must be provided with a cover for the function of protection. Each of these covers is a closure cap that has an annular mounting portion extended therefrom to engage in a mounting groove provided on the main body of the receptacle set for assembling.

By the fact that the receptacles themselves have sizes of a predetermined specification, the annular mounting portions each must be made with quite a large size to be engaged in a mounting groove, hence material is wasted quite much. Besides, the connecting action for engaging an annular mounting portion in a mounting groove is harder; particularly the annular mounting portion is subjected to be broken by stretching and thereby is no more useful, or the annular mounting portion which surrounds a receptacle is subjected to being worn out and broken after use for a long time.

Further, referring to FIG. 5 showing a housing for a conventional electrical connector, as is in the U.S. Pat. No. 5,573,412, the electrical connector 914 has a housing 912 therearound, a closure cap 916 can be closed over the front side of the electrical connector 914. The closure cap 916 is integrally connected with a mounting gasket 918 provided on the rear side of the electrical connector 914; the housing 912 and the mounting gasket 918 can be fixedly attached by using screws or an appropriate pressing member. It is very difficult in assembling to fix by using the screws or the appropriate pressing member, this will largely increase the working hours in manufacturing a receptacle set, and also increase the cost of manufacturing.

In view of the above stated; the multiplex receptacle set having receptacle covers is really necessary to be improved.

SUMMARY OF THE INVENTION

In view of the above defects of the conventional techniques, the structure for connecting a plurality of covers with the main body is redesigned in the present invention. In the present invention, each of a plurality of receptacles of a multiplex and multi-directional receptacle set is provided on a lateral side thereof with an insertion socket formed integrally therewith and having a through hole; the covers are openably and closably provided on the receptacles and each has a bent strip extended laterally thereof; the bent strip has a conical engaging block on its tailing end. All the engaging blocks are used to be directly engaged in the through holes of the insertion sockets to form connection; so that the covers are kept at the sockets to be opened or closed relative to the sockets. Thereby, the covers are easily and firmly assembled at the sockets to be convenient for operation of a user to open or close, and an effect of saving material can be obtained.

And more, for the designing of the covers for the multiplex and multi-directional receptacle set of the present invention, the insertion sockets on the multi-directional receptacle set extend in the same horizontal plane as that of the main body, so that the bent strips of the covers are in the same horizontal plane too; and when in closing and opening the covers, the bent strips will not protrude out of the main body.

The present invention will be apparent in its structural features and effect of operation after reading the detailed description of the preferred embodiment thereof in reference to the accompanying drawings.

DETAILED DESCRIPTION OF THE PREFERRED EMBODIMENT

Figure 1:
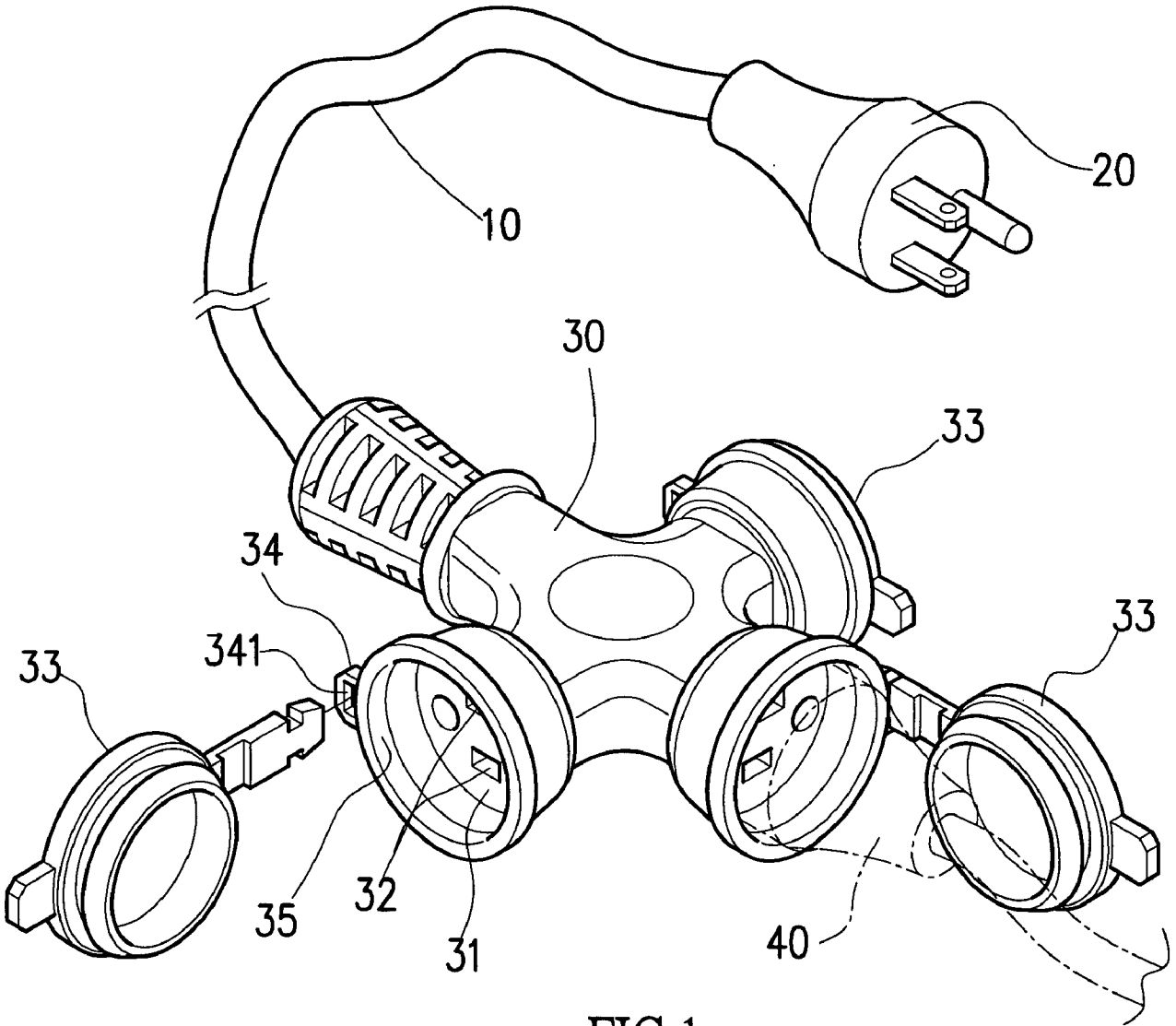
FIG. 1 is a perspective view showing a preferred embodiment of the present invention.

Referring to FIG. 1, a multiplex and multi-directional receptacle set for the present invention has an extension line 10 of which one end is a plug 20 that can be connected to an electric power supply, and of which the other end is connected to a main body 30 of the multi-directional receptacle set. The main body 30 of the multi-directional receptacle set as shown in the embodiment of FIG. 1 has three receptacles 31 in different orientations in a horizontal plane.

Insertion holes 32 of each receptacle 31 can be closed by covering of a cover 33 of the present invention, such as is shown in FIG. 1, in order to get an effect of dust and water proofing.

The cover 33 can also be opened away from the receptacle 31, so that the insertion holes 32 can be inserted therein with a plug 40, such as is shown in FIG. 1, in order to make electric connection.

A lateral side of each receptacle 31 formed on the main body 30 has an insertion socket 34 (having a through hole 341) extending in the same horizontal plane as that of the main body 30 and out of the main body 30.

Figure 2:
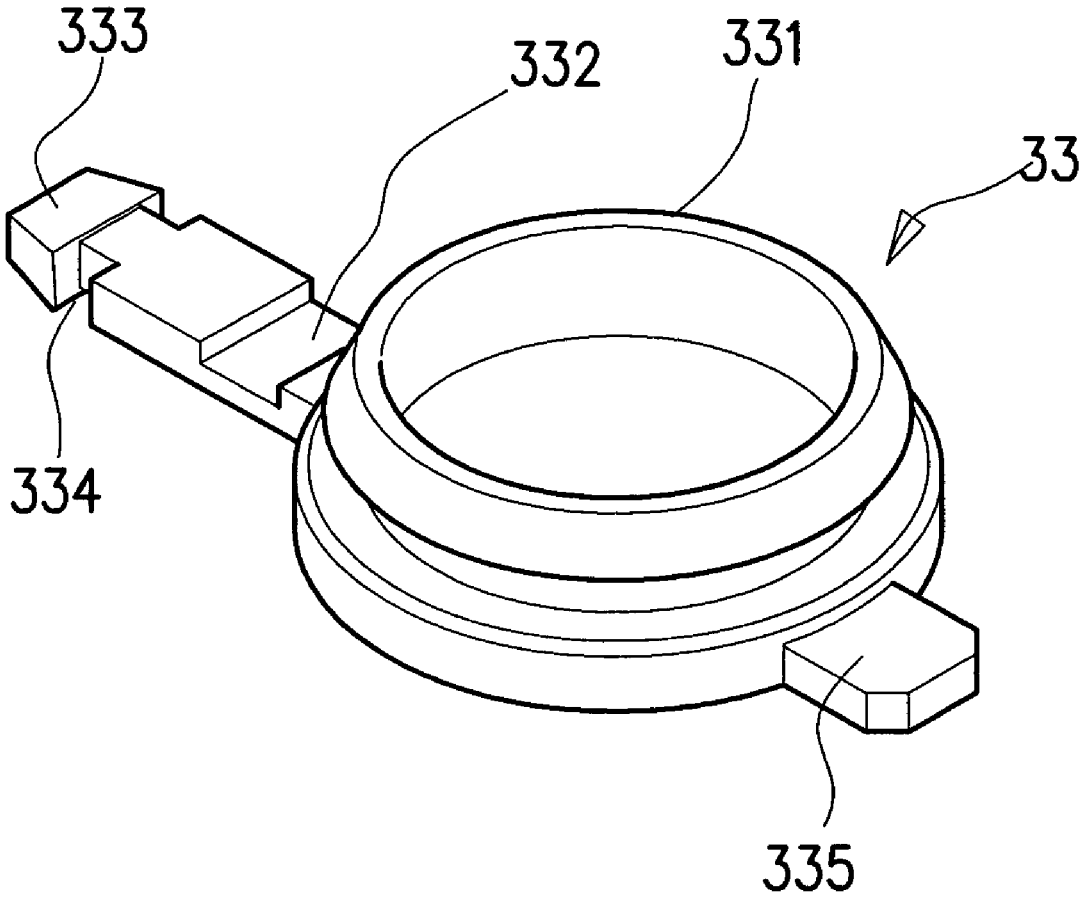
FIG. 2 is an enlarged perspective view of a cover of the present invention.
Figure 3:
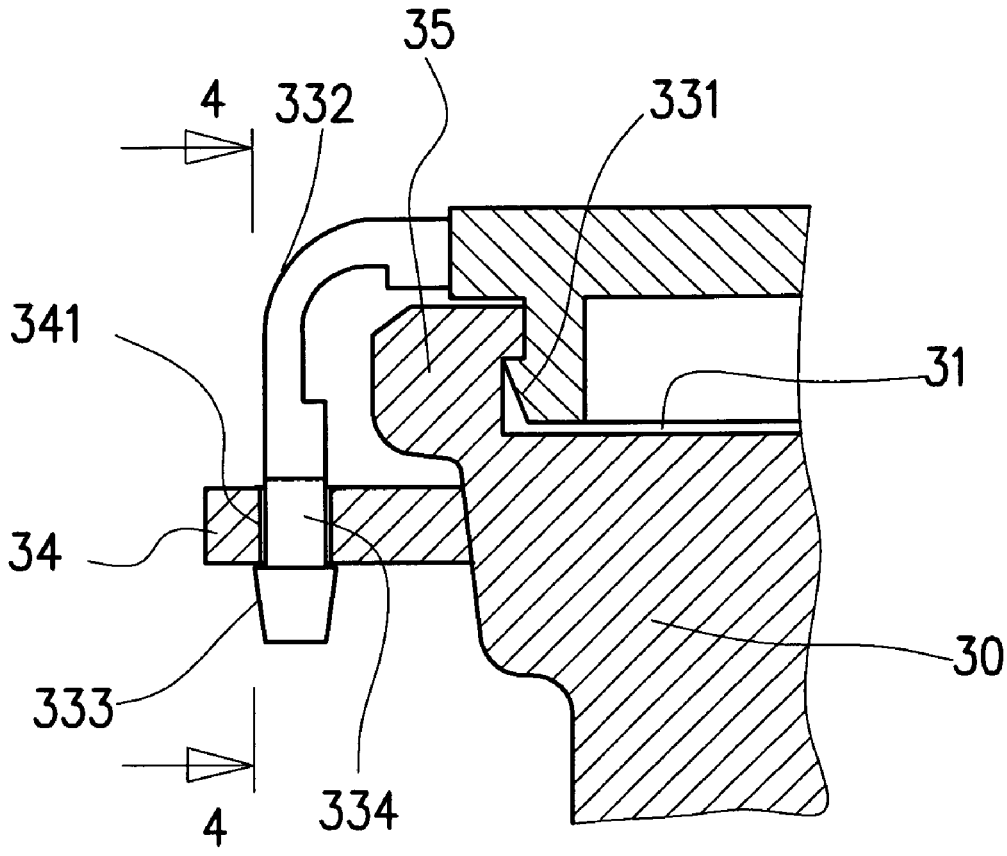
FIG. 3 is a sectional view showing a part of the present invention.

As shown in FIG. 2, the cover 33 is basically a lid having an inserting portion 331 of which the outer diameter closely matches with the inner diameter of a protruding annulus 35 formed on the periphery of the receptacle 31; and in closing it onto the receptacle 31, it can firmly close the receptacle 31 as is depicted in the sectional view of FIG. 3.

Figure 4:
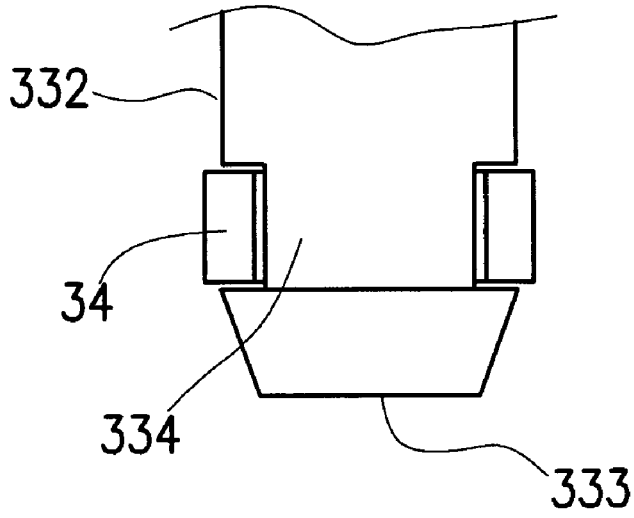
FIG. 4 is a sectional view taken along the arrows in FIG. 3.
Figure 5:
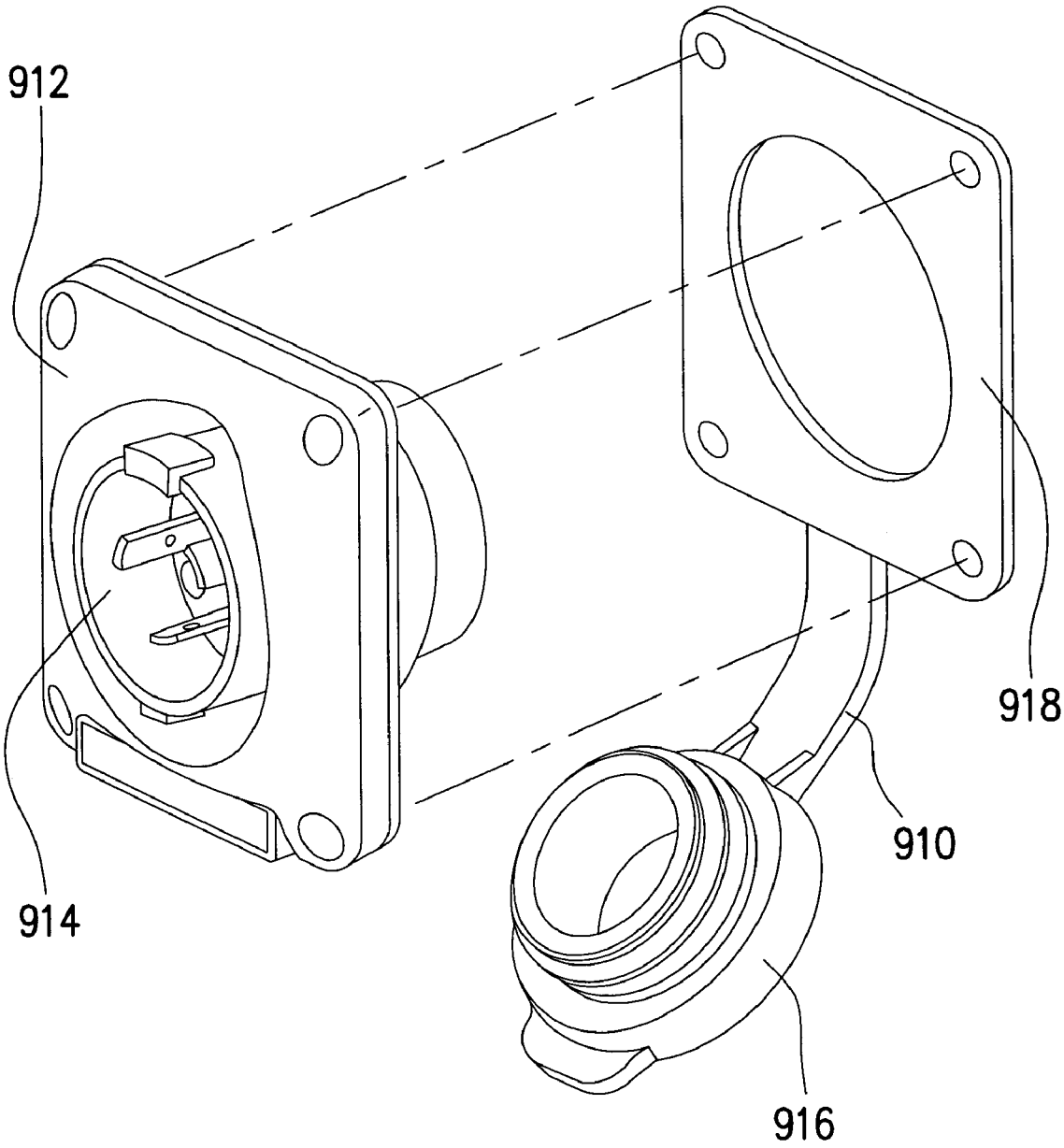
FIG.5 ( PRIOR ART )
FIG. 5 is a perspective schematic view of a housing of a conventional electric connector.

One side of the cover 33 has a bent strip 332 extending out of it, the tailing end of the bent strip 332 has an engaging block 333; the engaging block 333 is a conical member, the area of the bottom surface of the conical engaging block 333 is smaller than that of an opening of the through hole 341 on the insertion socket 34, while the top area of the conical engaging block 333 is larger than that of the opening of the through hole 341. The top area of the conical engaging block 333 is connected to a reduced part 334 with a width smaller than that of the through hole 341 as are shown in the embodiment of FIGS. 3 and 4. The reduced part 334 can be moved slightly in the through hole 341 in favor of moving the bent strip 332 and in order that the bent strip 332 is prevented from extending through the through hole 341.

Further, the side on the cover 33 opposite to that with the bent strip 332 has a push plate 335 protruding outwards for the convenience of pushing the push plate 335 by a user when the cover 33 is closed, to thereby open the cover 33.

Obviously, the cover 33 provided in the present invention is particularly beneficial to having it mounted on the insertion socket 34, because in assembling, it needs only to push the engaging block 333 on the tailing end of the bent strip 332 of the cover 33 into the through hole 341, when the upper side of the engaging block 333 passes through the through hole 341, by virtue that the area of the upper side is larger than that of the opening of the through hole 341, the upper side will not be retracted to disengage from the through hole 341. And by virtue that the engaging block 333 is designed to be a conical member with inclined peripheral sides, the engaging block 333 thereby can be extended through the through hole 341 easily.

In comparing the engaging block 333 with the annular mounting portion of the conventional technique, material used for the engaging block 333 is much saved, and in or after assembling, no defect of incurring of breaking exists.

Further, by the fact that the top area of the conical engaging block 333 is connected to the reduced part 334, thereby the bent strip 332 is prevented from extending through the through hole 341, and an effect of positioning is obtained and moving range of the bent strip 332 is diminished.

The embodiment shown in the drawings is used for receptacles respectively in three orientations; the present invention is applicable to duplex receptacle sets as well as multiplex receptacle sets, and hence is not limited to the above triplex receptacle set.

While the covers 33 shown in the drawings each has an inserting portion 331 which matches with the protruding annulus 35 formed on the periphery of the receptacle 31; but if there is no protruding annulus 35, the covers 33 of the present invention can be designed as a simple cover. This is an alternation that can be easily done, all such modifications and changes also fall within the scope of the appended claims and are intended to form part of this invention.

The invention claimed is:

1. A multi-directional receptacle set for an extension line comprising:

a) a main body connected to the extension line on an end opposite a plug and having a plurality of receptacles in a common plane and positioned in different directions, each of the plurality of receptacles having:

i) a plurality of insertion holes;

ii) an insertion socket located on an exterior periphery thereof and having a through hole; and iii) a protruding annulus protruding outwardly from a periphery thereof around the plurality of insertion holes; and b) a plurality of covers movable between open and closed positions, one of the plurality of covers is connected to each of the plurality of receptacles, each of the plurality of covers having:

i) an inserting portion, one inserting portion is inserted into the protruding annulus of each of the plurality of receptacles when each of the plurality of covers is located in the closed position, wherein the inserting portion having an outer diameter which approximately corresponds to an inner diameter of the protruding annulus; and ii) a bendable strip connected at a first end thereof to an exterior periphery of the main cover body and having an engaging block located on a second end thereof, the engaging block having a shape of a trapezoid, the engaging block securing the bendable strip of one of the plurality of covers in the through hole of the insertion socket of each of the plurality of receptacles.

2. The multi-directional receptacle set according to claim 1, wherein each insertion socket is located in the common plane.

3. The multi-directional receptacle set according to claim 1, wherein each engaging block having a first block end located on the second end of the bendable strip and a second block end spaced apart from the second end, the first block end having a width less than a width of the through hole, the second block end having a width greater than the width of the through hole, the second block end securing the bendable strip of one of the plurality of covers in the through hole of each of the plurality of receptacles.

4. The multi-directional receptacle set according to claim 1, wherein the engaging block of each bendable strip has a reduced part located adjacent the second block end, the reduced part having a width less than the width of the width of the through hole.

5. The multi-directional receptacle set according to claim 1, wherein each of the plurality of covers has a push plate extending outwardly from exterior periphery of the main cover body on a side opposite the bendable strip, each push plate is accessible when each of the plurality of covers is located in the closed position.

* * * * *